United States Patent [19]

Niederer et al.

[11] Patent Number: 5,056,979

[45] Date of Patent: Oct. 15, 1991

[54] LIFT UNIT FOR LIFTING AND EMPTYING WASTE CONTAINERS

[75] Inventors: Kurt W. Niederer, Charlotte; John T. Prout, Winston-Salem, both of N.C.

[73] Assignee: Toter, Inc., Statesville, N.C.

[21] Appl. No.: 529,158

[22] Filed: May 25, 1990

[51] Int. Cl.[5] ..... B65F 3/06

[52] U.S. Cl. ..... 414/408; 414/303; 414/421; 414/555; 414/786

[58] Field of Search ..... 414/303, 406, 408, 419, 414/421, 555, 786, 622

[56] References Cited

U.S. PATENT DOCUMENTS

| | | | |
|---|---|---|---|
| 3,484,006 | 12/1969 | Burke | 414/303 |
| 3,747,785 | 7/1973 | Dahlin | 414/303 |
| 4,272,217 | 6/1981 | Sefeik | 414/421 X |
| 4,461,608 | 7/1984 | Boda | 414/408 |
| 4,613,271 | 9/1986 | Naab | 414/303 |
| 4,669,940 | 6/1987 | Englehardt et al. | 414/555 X |
| 4,722,656 | 2/1988 | Naab | 414/303 |

FOREIGN PATENT DOCUMENTS

| | | | |
|---|---|---|---|
| 1013001 | 12/1965 | United Kingdom | 414/406 |

*Primary Examiner*—Robert J. Spar
*Assistant Examiner*—James Keenan
*Attorney, Agent, or Firm*—W. Thad Adams, III

[57] ABSTRACT

A lift unit for lifting and inverting waste containers for emptying. The waste containers are of the type having an enlarged lip proximate the mouth of the container. The lift unit includes grippers for gripping the enlarged lip of the container and lifting arms for lifting and inverting the waste container for emptying while gripped by the enlarged lip. The lift unit includes a support for supporting the side of the waste container while the container is being lifted and inverted. The grippers are carried by the lifting arms. The pair of opposed lifting arms can be adjusted to waste containers of different heights and widths.

17 Claims, 10 Drawing Sheets

LIFT UNIT FOR LIFTING AND EMPTYING WASTE CONTAINERS

TECHNICAL FIELD AND BACKGROUND OF THE INVENTION

This invention relates to a lift unit for lifting and emptying containers, particularly heavy duty plastic waste containers of the type generally referred to as "roll out" containers and are typically used by municipalities for waste collection. Refuse is placed by a business or home owner and rolled to the street periodically for collection. These containers are quite large and can hold between 100 and 200 pounds of waste material. For this reason refuse collection trucks are typically equipped with lift units which grasp the container in some fashion and lift it upwardly while inverting it sufficiently to cause the contents fall into the hopper of the truck.

Prior art lift units include types which squeeze the container between arms sufficiently tightly to enable the lift unit to be raised and emptied and types which use hooks to engage with hooks or bars molded into or attached to the containers. The hooks remain engaged while the lifting and emptying take place. While these methods usually achieve satisfactory results, squeezing the containers can puncture or otherwise damage the containers, particularly when sharp objects such as bottles reside within the container near the walls of the container. In bad weather, when the container is wet with rain or ice, the container may slip from the arms, damaging the container and perhaps injuring someone standing nearby.

Lifting the containers with hooks presents its own problems. When the truck is parked on a hill or slope, the lift unit may not vertically or laterally align itself with the hooks or bars on the container in the proper manner. Attempting to lift a container under these conditions can damage the container by bending the lifting bar or ripping it from its anchoring bracket. Recent advances the applicant, Toter, Inc., has made in molding plastic waste containers permits the incorporation of integrally molded enlarged lips and rims into the body of the container. These structures reinforce the container, particularly around the mouth of the container where it is subject to repeated deformation. By reinforcing the mouth of a container, the lid can be designed to fit more tightly and will fit properly for a longer period of time.

SUMMARY OF THE INVENTION

Therefore, it is an object of the invention to provide a lift unit which can use the enlarged lip on a plastic molded waste container to grip the container and lift and invert it for emptying.

It is another object of the invention to provide a lift unit which can adjust for and lift differing sizes of containers.

It is another object of the invention to provide a lift unit which can lift a plastic roll-out waste container without damaging the container.

These and other objects of the present invention are achieved in the preferred embodiments disclosed below by providing a lift unit for lifting and inverting waste containers for emptying. The waste containers are of the type having an enlarged lip proximate the mouth of the container. The lift unit includes gripping means for gripping the enlarged lip of the container and lifting means for lifting and inverting the waste container for emptying while gripped by the enlarged lip.

According to one preferred embodiment of the invention, the lift unit includes support means for supporting the side of the waste container while the container is being lifted and inverted.

According to another preferred embodiment of the invention, the gripping means are carried by the lifting means, and the lifting means includes a pair of opposed lifting arms for partially encircling the waste container.

Preferably, the pair of opposed lifting arms include adjustment means for being adjusted to waste containers of different heights and widths.

According to one preferred embodiment of the invention, the gripping means comprises a lower gripper and a cooperating upper gripper attached to each of the opposed lifting arms.

Preferably, the lower gripper is stationary relative to the lifting arm to which it is attached and the upper gripper is movable into and out of gripping cooperation with the lower gripper for alternately gripping and releasing the grip on the enlarged lip of the waste container.

According to another preferred embodiment of the invention, the lower gripper supports the bottom of the enlarged lip of the waste container and the upper gripper engages the top of the enlarged lip of the waste container and traps the enlarged lip between the lower gripper and the upper gripper while the container is lifted and inverted.

Preferably, the pair of opposed lifting arms include adjustment means for being adjusted to waste containers of different heights and widths, and the gripping means comprises upper and lower grippers for gripping the enlarged lip of the waste container therebetween. Each of the lifting arms carry at least one of each of the upper and lower grippers. Locking means are provided for locking the upper gripper into position on top of the enlarged lip of the container during lifting and inverting of the container.

According to one preferred embodiment of the invention, the lift unit includes a stationary mounting frame for securing the lifting means to a supporting structure. The lifting means are pivotally mounted to the mounting frame and include fluid-powered piston and cylinder means interconnecting the mounting frame and the lifting means for reciprocating pivotal movement of the lifting means between a lowered container loading and unloading position and a raised emptying position.

According to yet another preferred embodiment of the invention, the piston and cylinder means comprises first and second piston and cylinder assemblies, one end of each of the piston and cylinder assemblies being secured to the mounting frame and the other end of the piston and cylinder assemblies secured to the lifting means.

Preferably, the first and second piston and cylinder assemblies are secured to the mounting frame and the lifting means in mutual angular offset to each other whereby at least one of the piston and cylinder assemblies is in a position of mechanical advantage during the entire movement cycle between the lowered container loading position, the raised emptying position and the lowered container unloading position.

Preferably, the lift unit includes folding means for folding the lifting arms into a collapsed, closed position of reduced depth.

Preferably, the supporting structure to which the lift unit is attached comprises a refuse truck.

An embodiment of the method according to the invention comprises the steps of providing a pair of opposed, spaced-apart lifting arms for receiving a waste container therebetween; and an upper gripper and a lower gripper on each of the pair of lifting arms. The enlarged lip of the waste container is gripped between the upper and lower grippers on each of the pair of lifting arms and the waste container is lifted by the enlarged lip to a raised and inverted position for emptying. The waste container is lowered from the raised and inverted position and the grip of the upper and lower grippers on the enlarged lip is released to permit removal of the waste container from between the lifting arms.

Preferably, the invention includes the steps of adjusting the lifting arms to the width of the waste container and adjusting the lifting arms to the height of the waste container.

Preferably, the invention includes the step of supporting the waste container on one of its side walls while the waste container is lifted, emptied and lowered.

The method according to another preferred embodiment of the invention, includes the step of maintaining the lower gripper in a stationary position relative to the lifting arm to which it is attached and moving the upper gripper into and out of gripping cooperation with the lower gripper for alternately gripping and releasing the grip on the enlarged lip of the waste container.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
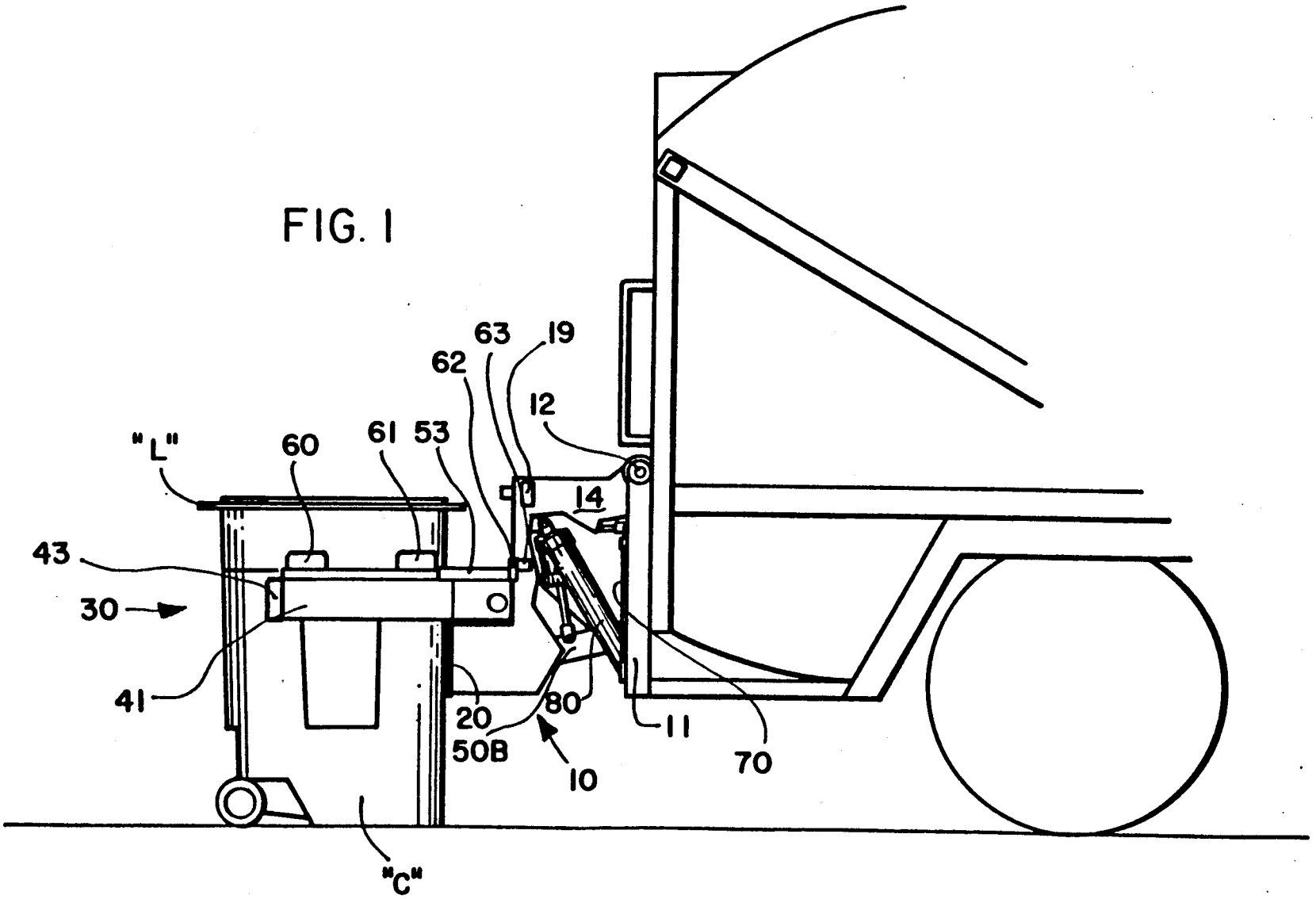
FIG. 1 is a side elevation of the lift unit in loading position.

Referring now specifically to the drawings, a lift unit according to the present invention is illustrated in FIG. 1 and shown generally at reference numeral 10. A waste container "C" having an enlarged lip "L" is shown in loading position.

Lift unit 10 is mounted to a waste collection truck by a stationary mounting frame 11. Lift unit 10 is pivotally mounted on journal bearings 12 for pivotal movement between a lower, loading position shown in FIG. 1 and an upper emptying position shown in FIG. 7.

Figure 2:
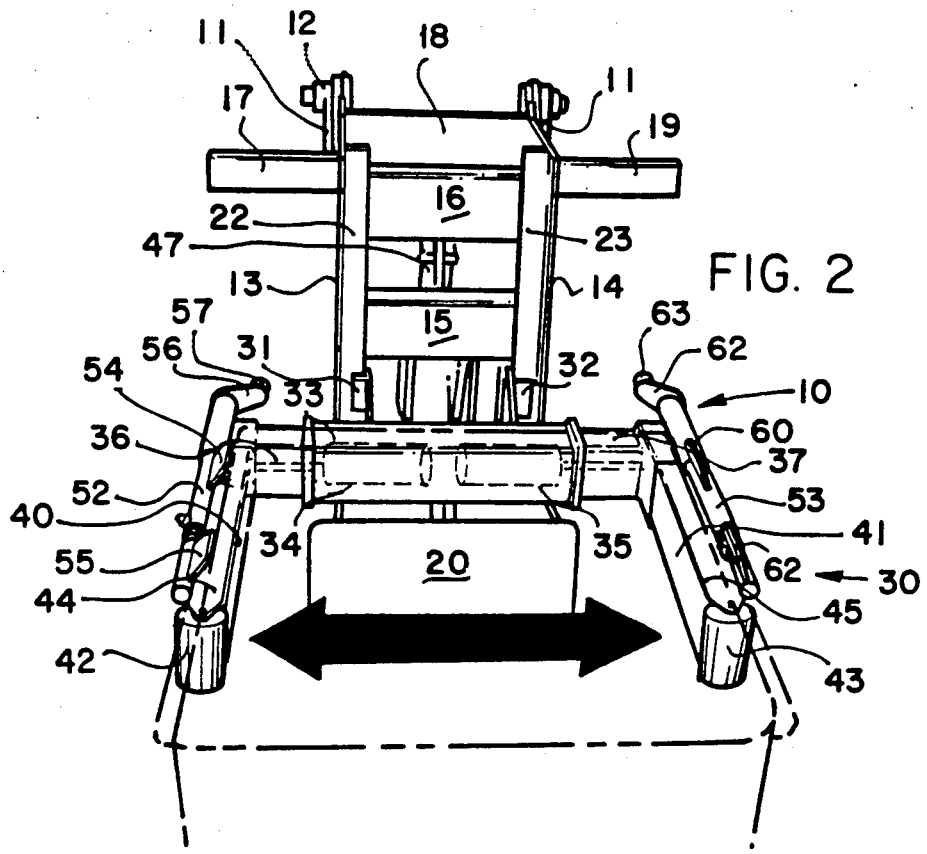
FIG. 2 is a perspective view from the rear of the lift unit showing adjustment of the lifting arms to different widths of containers.

Referring now to FIG. 2, lift unit 10 includes a pair of plate steel side walls 13, 14 secured to and extending outwardly from a back plate 18. The side walls 13, 14 are braced by a pair of cross-braces 15 and 16. A pair of cam actuators 17, 19 are welded to and extend laterally outwardly from side walls 13, 14, respectively. The function of cam actuators 17, 19 is explained below.

A container supporting face plate 20 extends rearwardly from the bottom of the side walls 13, 14 and supports the inwardly facing side of the container "C" during lifting and emptying, as is shown in several of the Figures, including FIGS. 1, 5, 6 and 7.

LIFTING ARM ASSEMBLY

An arm assembly broadly indicated at 30 is mounted for vertical sliding movement on a pair of tracks 22, 23 which extend upwardly between side walls 13, 14, respectively. A pair of track guides 31, 32 ride on tracks 22, 23 and are secured to a stationary cylinder housing 33 in which are positioned a pair of hydraulic arm width adjusting cylinder assemblies 34, 35. A pair of sliding cylinder housings 36, 37 are telescoped with opposing ends of stationary cylinder housing 33 and move inwardly and outwardly as hydraulic fluid is applied to one end or the other of the arm width adjusting cylinder assemblies 34, 35.

A pair of outwardly extending lifting arms 40, 41 are connected to the outer ends of sliding cylinder housings 36, 37, respectively, so that as the sliding cylinder housings 36, 37 move inwardly and outwardly, the lifting arms 40, 41 likewise move inwardly and outwardly, as is graphically shown in FIG. 2. Rollers 42, 43 are mounted on the ends of lifting arms 40, 41, respectively and aid in guiding the container properly into the area between lifting arms 40, 41 for loading.

Figure 3:
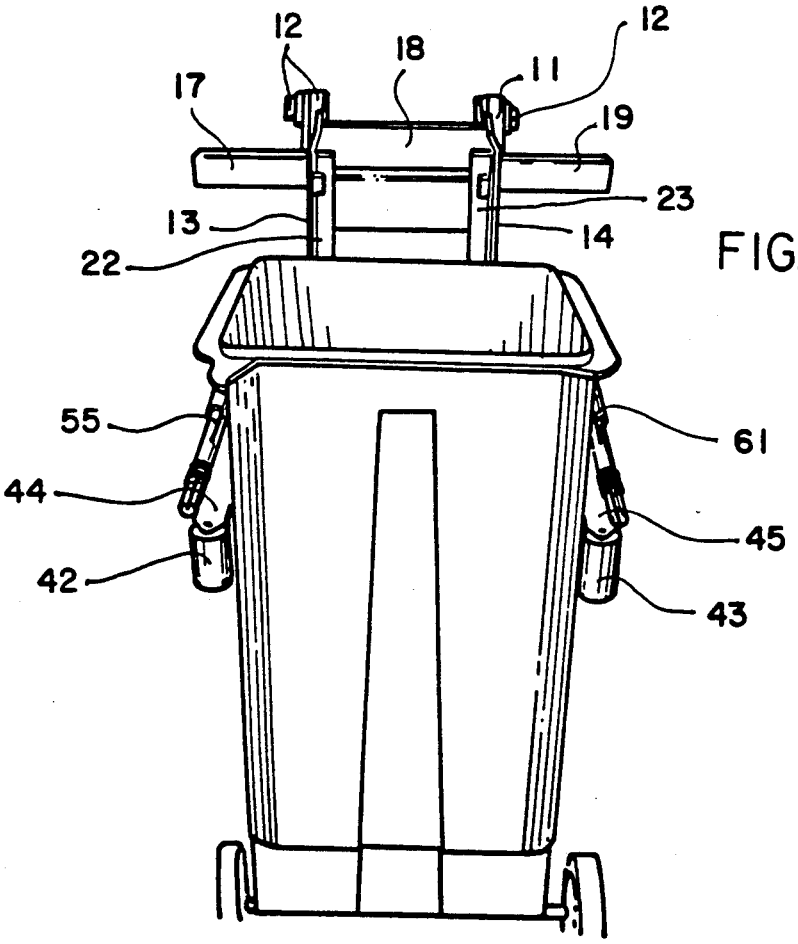
FIG. 3 is a perspective view according to FIG. 2 showing proper adjustment of the lifting arms on the waste container.

As is shown in FIG. 3, after the container has been moved into position between lifting arms 40, 41, the arm width adjusting cylinder assemblies 34, 35 are actuated and move the lifting arms 40, 41 inwardly into contact with the container. The extent of movement of the arm width adjusting cylinder assemblies 34, 35 can be controlled by a limit switch or manually by the lift unit operator in a conventional manner.

Figure 8:
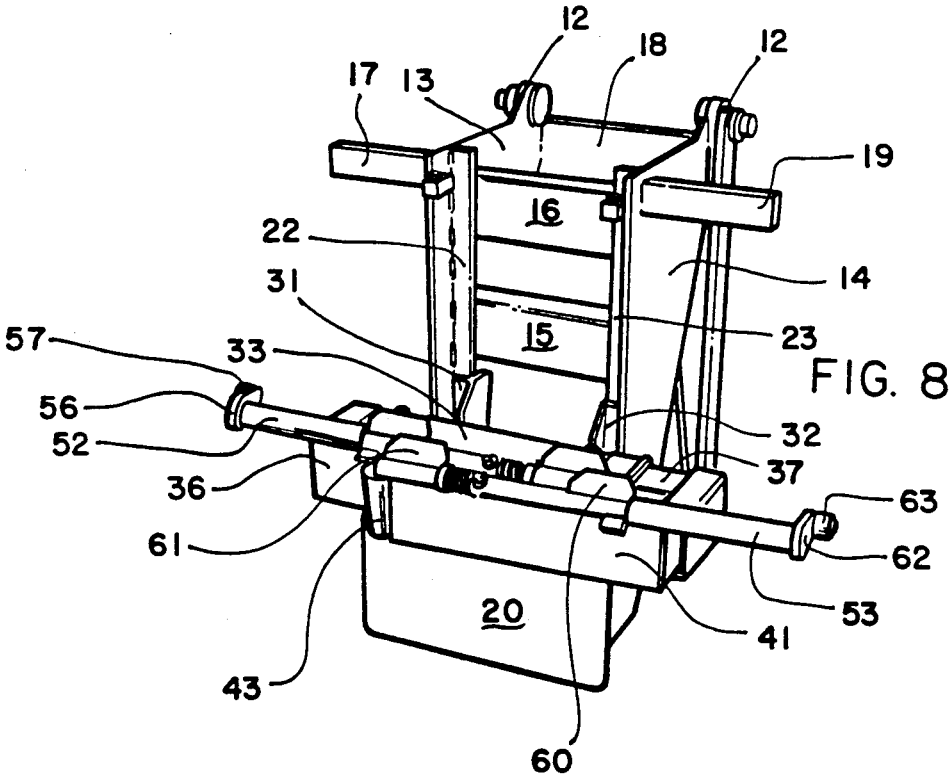
FIG. 8 is a view showing the arms folded inwardly for transport.
Figure 9:
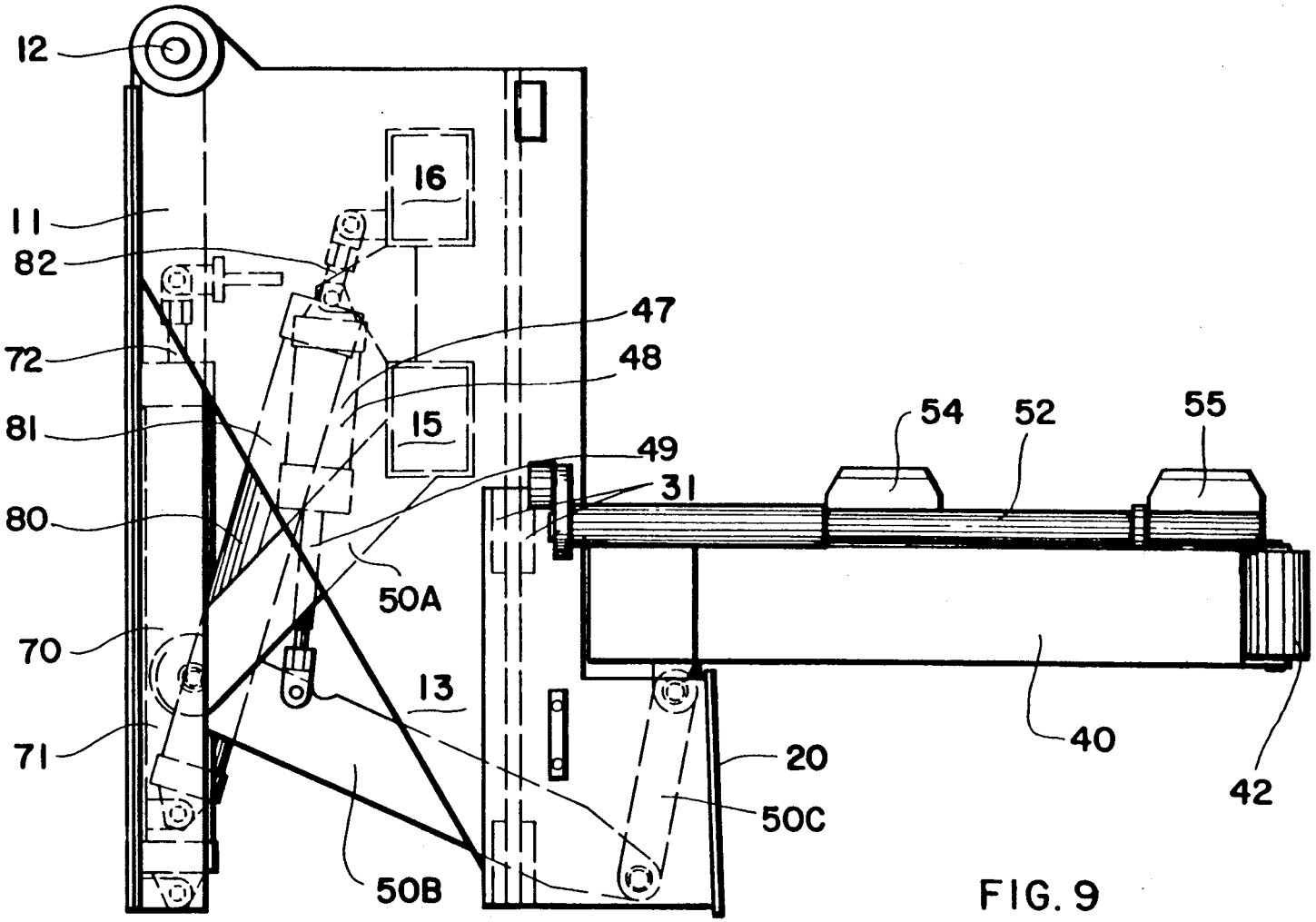
FIGS. 9 and 10 are sequential schematic views showing the cooperating movement of the various operating components of the lift unit during loading of a waste container.

After lifting arms 40, 41 have been moved inwardly to the appropriate distance in contact with the container, the lifting arms 40, 41 are raised to the point where they reside just below the enlarged lip "L" around the mouth of the container. This is accomplished by a hydraulic arm lifting cylinder assembly 47. This cylinder assembly 47 can be seen in FIG. 2, but is best shown in FIGS. 8 and 9. As is shown in FIG. 9, arm lifting cylinder assembly 47 includes a hydraulic cylinder 48 in which is mounted a piston (not shown) which carries a piston rod 49. Cylinder 48 is pivotally mounted on brace 16 and piston rod 49 is pivotally-mounted on a pivoting three segment actuator arm 50A, 50B, 50C. Actuator arm segment 50A is pivotally mounted on brace 15. Actuator arm segment 50B is pivotally mounted at one end to the free end of actuator arm 50A and at the other end to actuator arm 50C, which in turn is pivotally mounted by the other end onto the bottom of the stationary cylinder housing 33.

As is shown by comparing the position of the actuator arm segments 50A, 50B, 50C in FIGS. 8 and 9 in relation to the height of lifting arm 40, withdrawal of piston rod 49 into cylinder 48 pivots actuator arm segment 50B upwardly, causing actuator arm segment 50C to push lifting arms 40, 41 upwardly. Preferably, the upper movement of the lifting arms 40, 41 is sufficient to lift the container off of its supporting surface. In this way direct contact between the arms and the lip of the container is insured.

CONTAINER GRIPPERS

Figure 4:
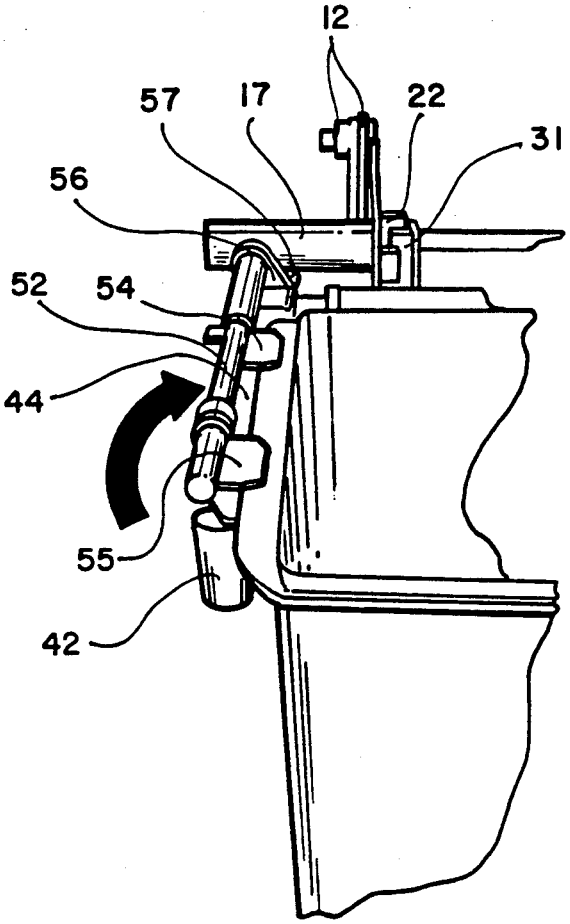
FIG. 4 is a fragmentary perspective view showing the grippers moving into position over the enlarged lip of the container.

The upper longitudinally-extending surfaces of lifting arms 40, 41 define lower grippers 44, 45, respectively. As is shown in FIGS. 3 and 4, bars 52, 53 are rotatably mounted onto the top of lifting arms 40, 41 above lower grippers 44, 45, respectively. Bar 52 carries a pair of upper grippers 54, 55 and a cam 56 with a cam follower 57 on the end adjacent side wall 13. Bar 53 carries a pair of upper grippers 60, 61 and a cam 62 with a cam follower 63 on the end adjacent side wall 14. Upper grippers 54, 55, 60, 61 are spring-loaded and normally assume a position of about 60–90 degrees to the plane of the lower grippers 44, 45. For this the upper grippers 54, 55, 60, 62 do not extend inwardly as far as the lower grippers 44, 45 and pass by the lip of the container as the lifting arms 40, 41 are being raised. This movement puts the lower grippers 44, 45 directly below the lip of the container and the upper grippers 54, 55, 60, 61 directly above the lip of the container. As noted above, the lifting arms 40, 41 are raised to the point where the container is lifted off of its supporting surface. This insures direct contact between the lower grippers 44, 45 and the lip of the container and permits clamping of the lip independent of the height of the container.

As is shown in FIG. 4, as the lifting arms 40, 41 move upwardly toward the lip of the container, cam followers 57 and 63 are forced against the lower surface of cam actuators 17, 19, respectively. The movement causes cams 56 and 62 to rotate bars 52 and 53, respectively, thereby rotating the upper grippers 54, 55, 60, 61 into engagement with the top of the lip of the container. With the container securely within the grip of the lower and upper grippers as described, the lifting and emptying phases begin.

CONTAINER LIFTING AND EMPTYING

Figure 5:
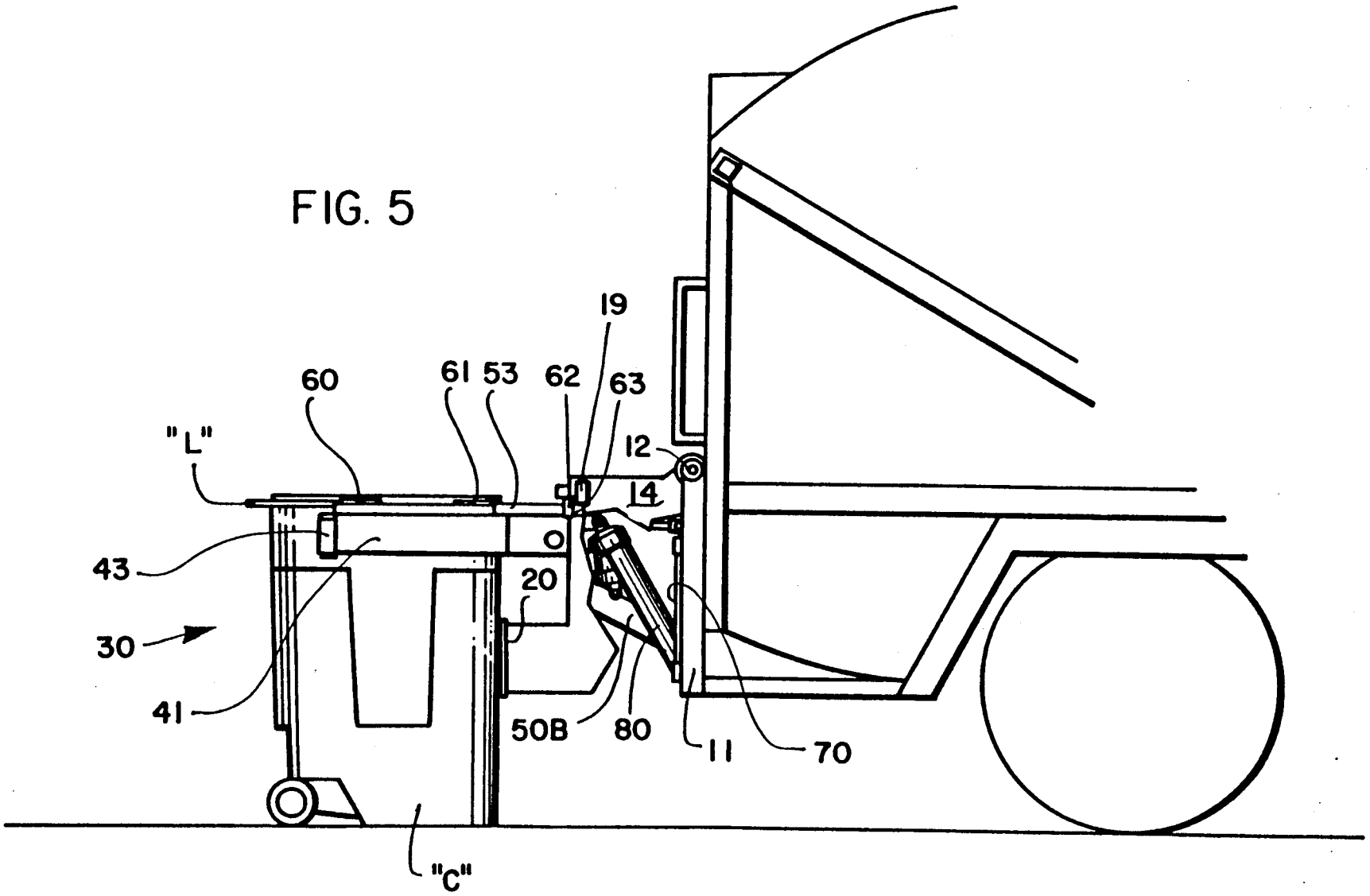
FIGS. 5, 6 and 7 show the stages of the lifting and emptying motion of the lift unit.
Figure 6:
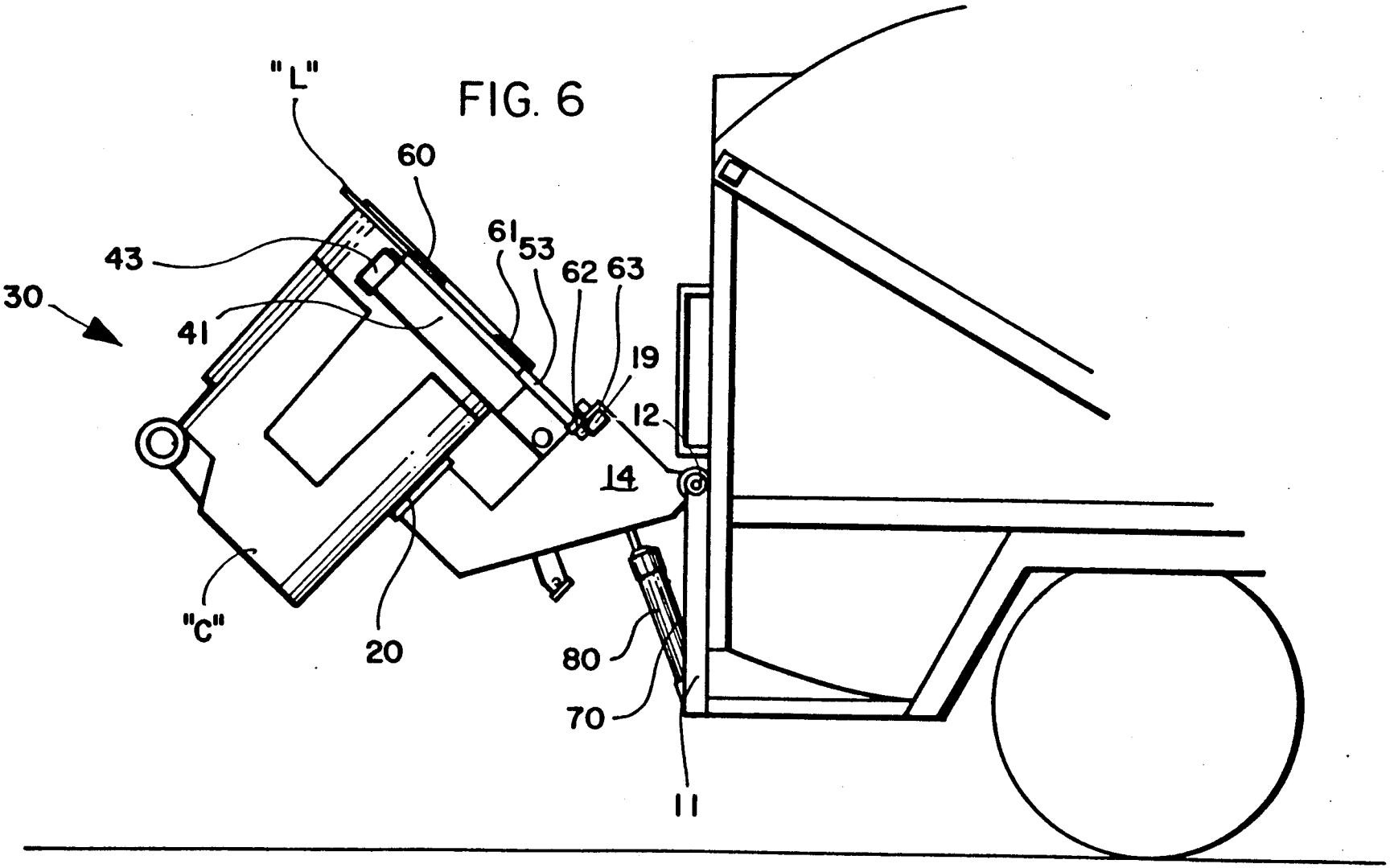
Figure 7:
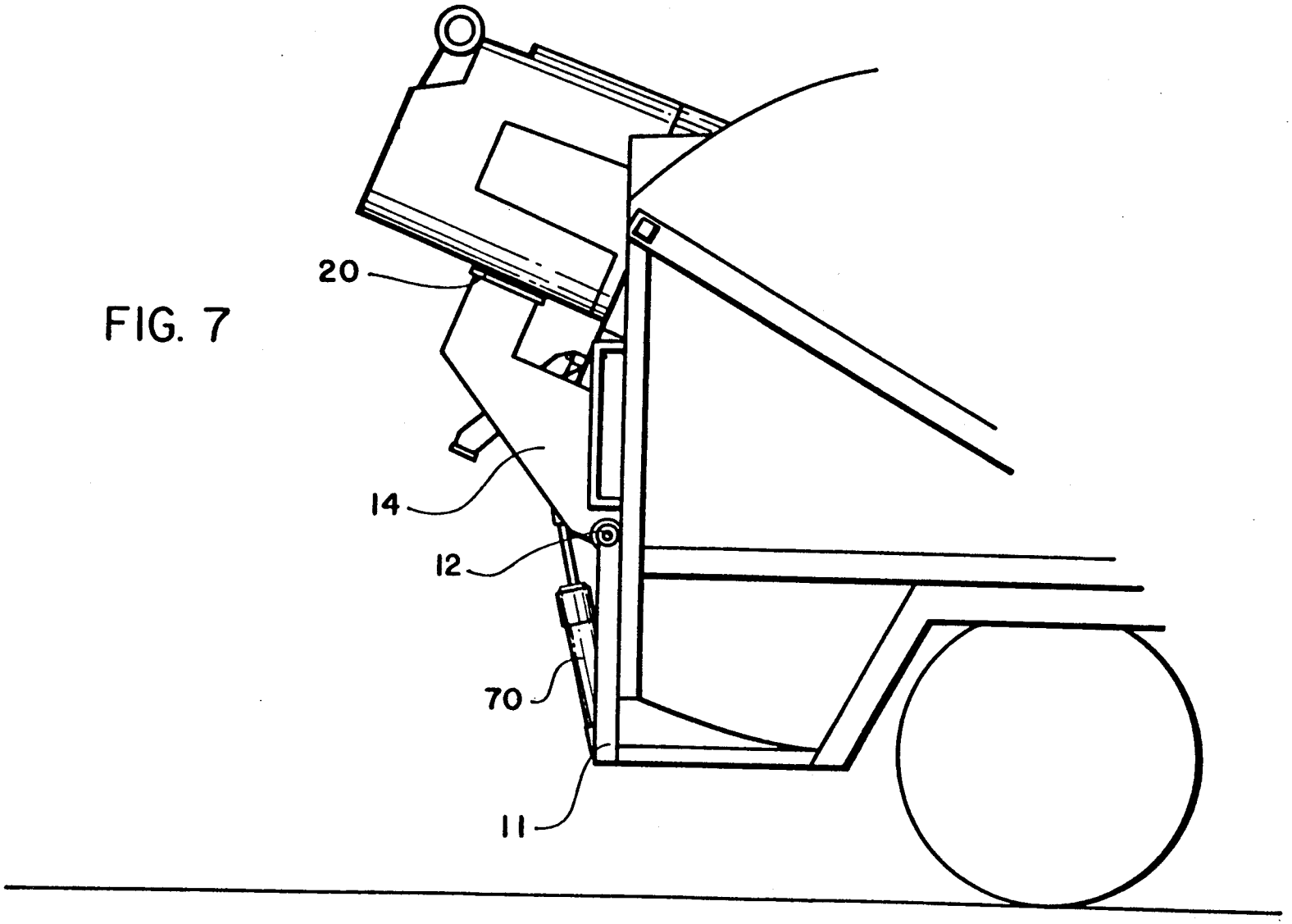
Figure 10:
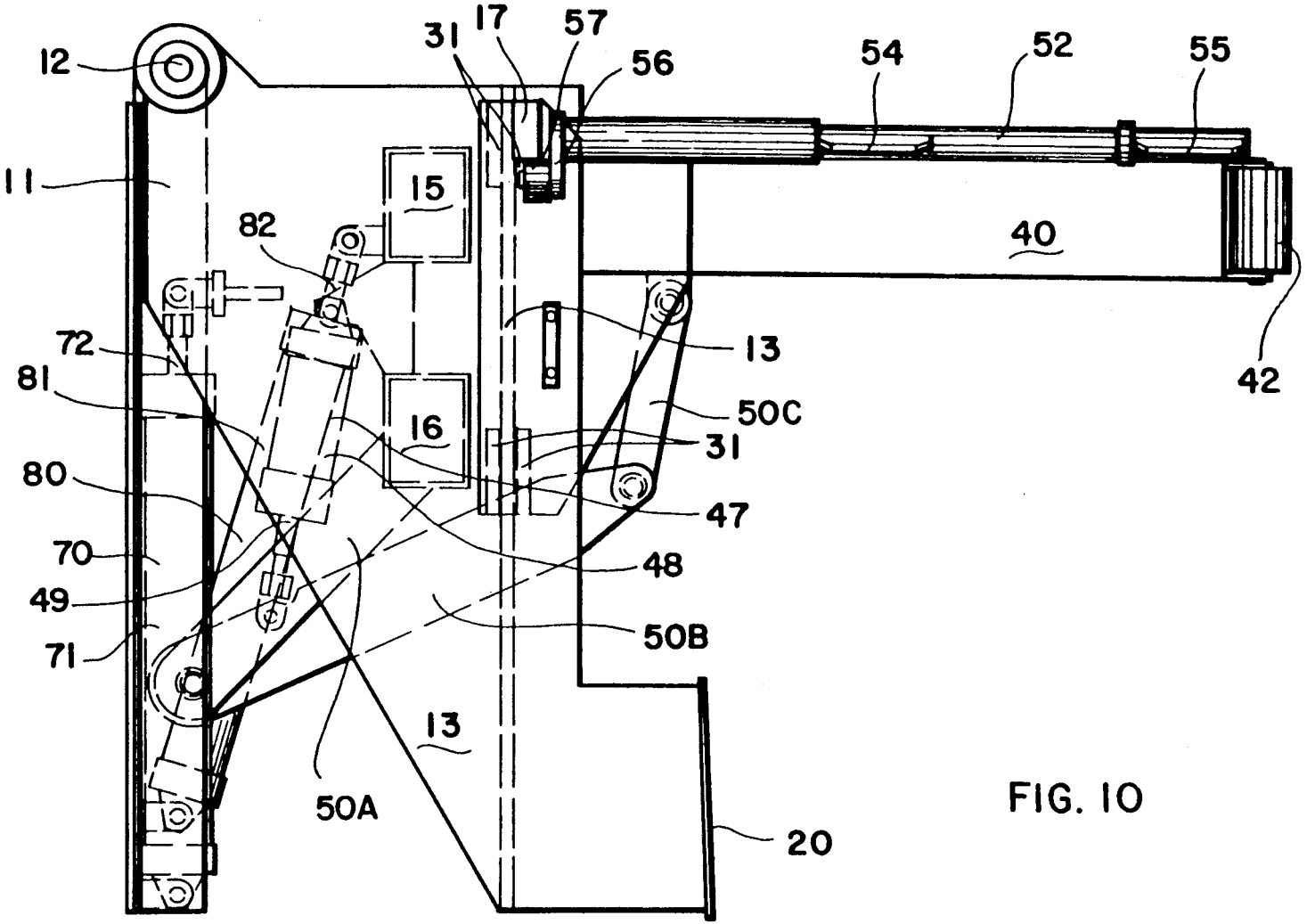
Figure 11:
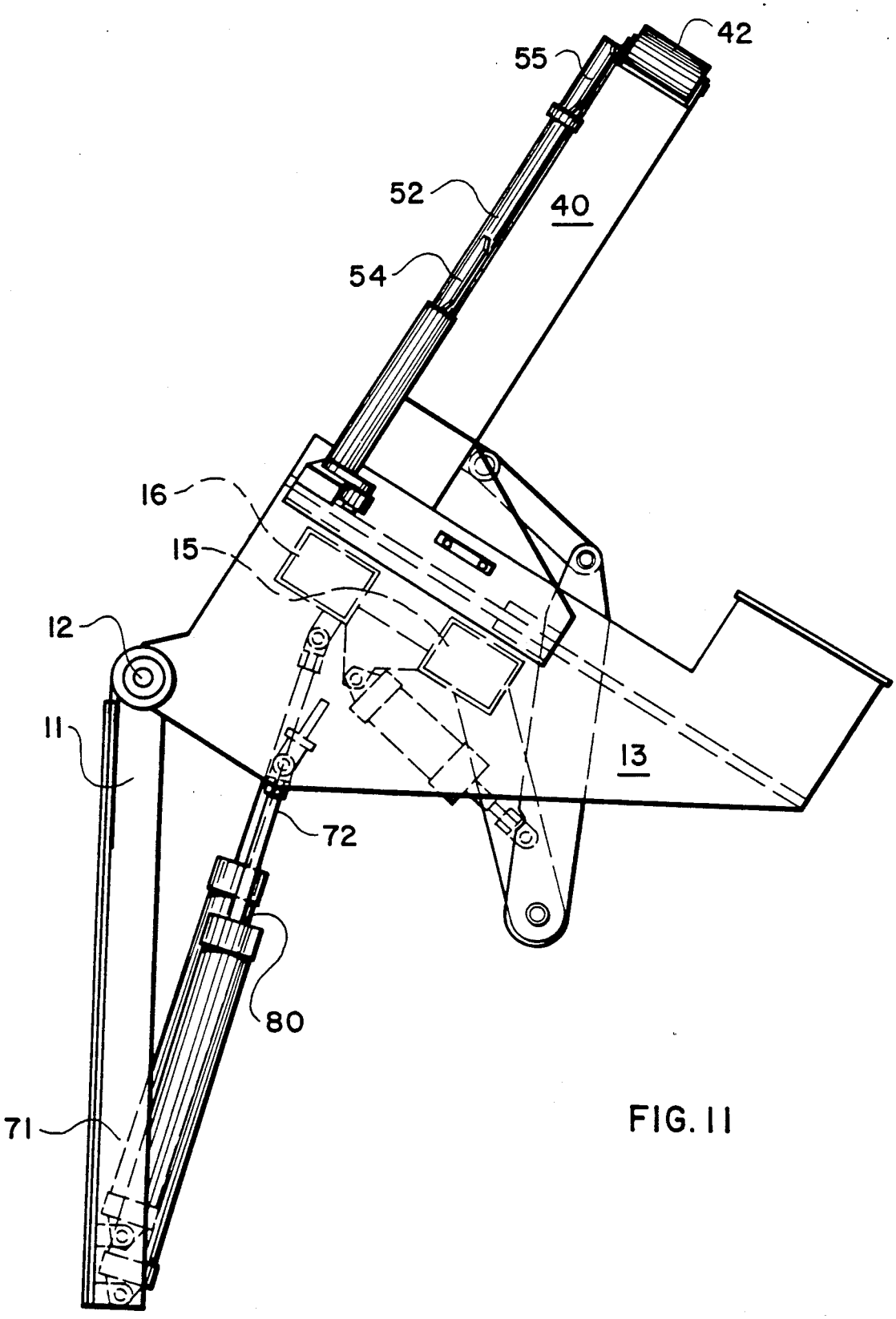
FIGS. 11 and 12 are sequential schematic views showing the cooperating movement of the various operating components of the lift unit during lifting of a waste container.
Figure 12:
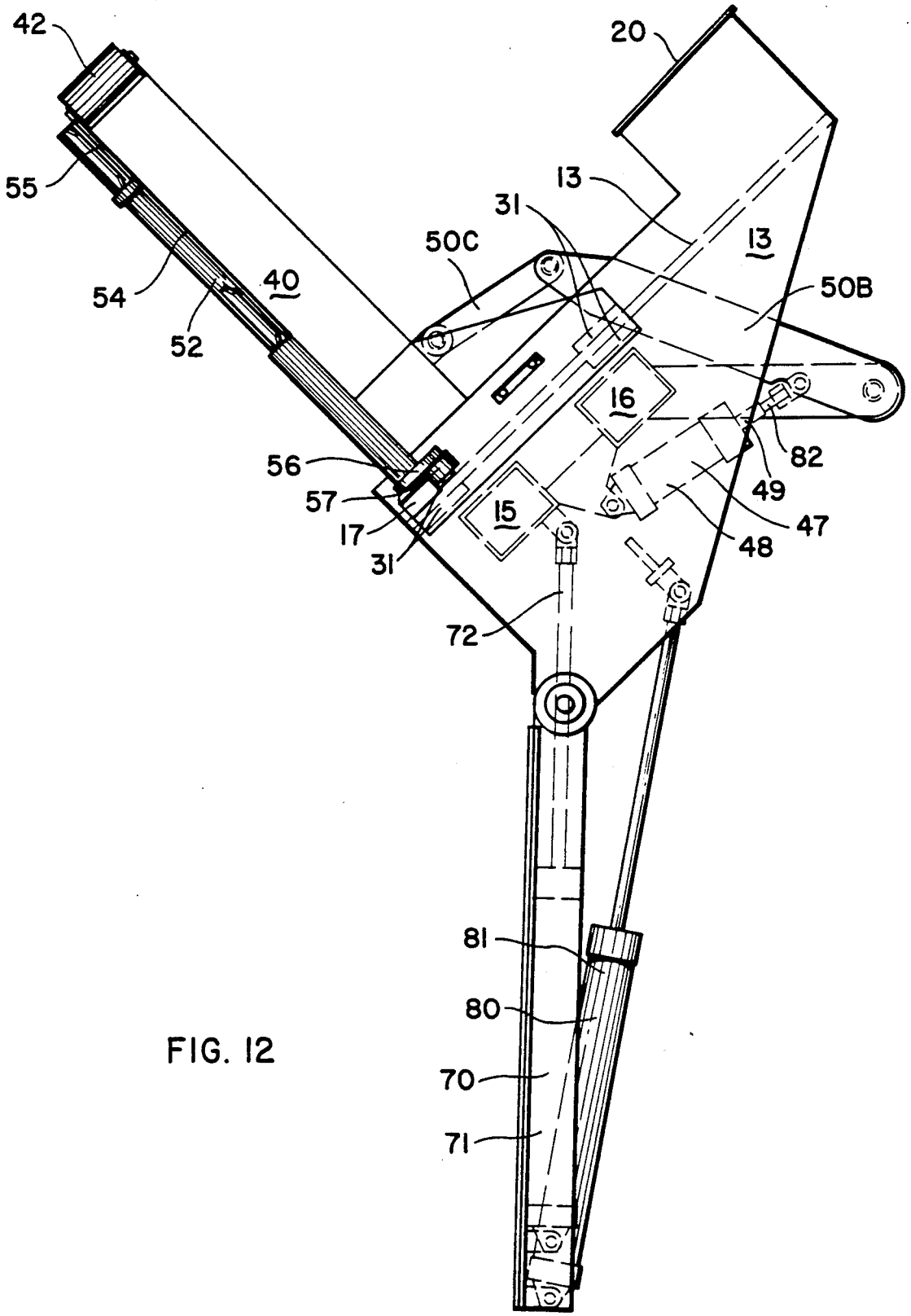

FIGS. 5, 6 and 7 generally illustrate the lifting and emptying motion of lift unit 10. This motion is accomplished by pivoting the lift unit 10 around the bearing journals 12. As is shown in FIGS. 10, 11 and 12, a first hydraulic lifting cylinder assembly 70 includes a hydraulic cylinder 71 pivotally mounted to back plate 18 near its bottom. A piston (not shown) moves within the cylinder 71 and carries a piston rod 72 which is pivotally mounted by its free end to the interior of side wall 13. Note that in the position shown in FIG. 10 with the lift unit 10 in its lowered position, lifting cylinder assembly 70 is substantially perpendicular and in a parallel, flush relationship with the back plate 18.

A second hydraulic lifting cylinder assembly 80 includes a hydraulic cylinder 81 pivotally mounted to back plate 18 near its bottom. A piston (not shown) moves within the cylinder 81 and carries a piston rod 82 which is pivotally mounted by its free end to the back side of brace 16. Note that in the position shown in FIG. 10 with the lift unit 10 in its lowered position, lifting cylinder assembly 80 is angularly deviated from the perpendicular by about 25 degrees with reference to back plate 18 and the first lifting cylinder assembly 70.

As lifting unit 10 begins lifting the container, both cylinders 70 and 80 extend, with piston rods 72 and 82 pushing lift unit 10 pivotally upwardly. The angular deviation of the cylinder assembly 80 provides leverage and a distinct mechanical advantage as lifting begins. The container is held in the grippers, as described above, and is supported on the face plate 20, as is shown in FIGS. 5, 6 and 7. The pivoting movement of the lift unit 10 causes cylinder assembly 70 to pivot outwardly away from back plate 18. As is shown in FIG. 11, by the point where the lift unit 10 has pivoted approximately 75 degrees, both cylinder assemblies are cantilevered away from the back plate 18, thus providing substantial leverage which assists in the lifting operation while maintaining hydraulic pressure within reasonable limits.

Beyond the point illustrated in FIG. 11, cylinder assembly 80 moves toward the perpendicular to the point where, at the uppermost limit of the lifting phase, shown in FIG. 12, cylinder assembly 80 is parallel with and flush against back plate 18, and cylinder assembly 70 has moved outwardly approximately 10 degrees from the perpendicular. The position of cylinder assembly 70 provides leveraged support to lift unit 10 which permits a more controlled descent of the lift unit 10 than if the entire weight of the unit were supported by both cylinder assemblies 70 and 80 in a position flush with the back plate 18. Significantly, this arrangement also permits a wider arc of motion—up to 150—than if either one cylinder or two or more in-line cylinders were used. A single or pair of in-line cylinders would be able to move in an arc of only about 130.

CONTAINER LOWERING

The lowering of the container is essentially the lifting phase as described above in reverse. If necessary, the lift unit can be jogged once or more at the top of the emptying cycle to dislodge the contents of the container in to the truck.

As is also shown in FIGS. 11 and 12, the grippers continue to hold the container during the entire upward and downward movement of the container. This is most easily understood by comparing the position of the actuator arm segments 50A, 50B, 50C in FIGS. 11 and 12 remains unchanged in relation to each other and to the container during the entire lifting emptying and lowering phases. When the lift arms 40, 41 return the container to the upright position, arm lifting cylinder assembly 47 extends, and the actuator arm segments 50A, 50B, 50C lower the lifting arms 40, 41 from their position at the mouth of the container to the position shown in FIG. 3. As soon as a few inches of movement has occurred, the cam followers 57 and 63 are released from engagement with cam actuators 17, 19, respectively, causing the spring-loaded upper grippers 54, 55, 60 and 61 to rotate out of contact with the upper surface of the lip of the container, releasing the grip on the container and permitting further downward travel of the lifting arms 40, 41. When the lifting arms 40, 41 reach the position shown in FIG. 3, they then move away from each other as shown in FIG. 2, so that the container can be easily removed and another inserted.

Referring to FIG. 8, note that the lifting arms 40, 41 are mounted on the respective ends of the sliding cylinder housings 36 and 37, respectively, for 90 degree pivoting movement into the position shown, where the lifting arms 40, 41 are folded into a more compact storage position.

The hydraulic circuit which performs the functions set out above is conventional per se. The system can be operated manually or automatically. Limit switches, pressure switches, mechanical stops, or other equivalent devices can be used to control the range of the various motions as is desired. In general, the best mode for carrying out the invention would be to automate the operation of the lift unit 10 to the maximum practical degree since the design of the lift unit 10 and the method by which it operates are intended t automatically adjust for varying container sizes and shapes.

While a container has been shown which includes an enlarged lip completely around its mouth, lift unit 10 will lift any container which has a lip, rim or other enlarged structure in such a position in relation to the mouth of the container as to be gripped by the grippers. This could include short lip or rim segments generally coextensive in length and positioned in the container for gripping by the upper grippers 54, 55, 60 and 61. The particular size and shape of the upper grippers 54, 55, 60 and 61 is not critical. For example, a single upper gripper on each lifting arm 40, 41 with a length substantially the same as the lower grippers 44, 45 would also function adequately.

In summary, the arms of the lift unit are adjusted to the spacing proper for the particular container. Then, the container is lifted vertically off of its supporting surface. The lip of the container is clamped. Finally, the container is rotated into and out of emptying position.

A lift unit is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

We claim:

1. A lift unit for lifting and inverting a waste container for emptying, the waste container being of the type having an enlarged lip extending along the length of opposing sides of the container proximate the mouth of the container, and comprising:

(a) gripping means for gripping the enlarged lip of the container along the opposing sides of the container;

(b) lifting means for lifting and inverting the waste container for emptying while the enlarged lip is gripped by the gripping means, said gripping means being carried by said lifting means, and said lifting means including a pair of laterally opposed lifting arms for partially encircling the waste container in a non-gripping relation; and (c) said gripping means comprising an elongate lower gripper and a cooperating elongate upper gripper for gripping the lip of the waste container therebetween, both of said upper and lower grippers carried by respective ones of said pair of laterally opposed lifting arms and extending laterally along opposing sides of the container when the container is in a lifting position.

2. A lift unit according to claim 1, and including support means for supporting the side of the waste container while the container is being lifted and inverted.

3. A lift unit according to claim 1, wherein said pair of opposed lifting arms include adjustment means for being adjusted to waste containers of different heights and widths.

4. A lift unit according to claim 1, wherein said lower gripper is stationary relative to the lifting arm on which it is carried and said upper gripper is movable into and out of gripping cooperation with said lower gripper for alternately gripping and releasing the grip on the enlarged lip of said waste container.

5. A lift unit according to claim 1 and including locking means for locking the upper gripper into position on top of the enlarged lip of the container during lifting and inverting of the container.

6. A lift unit according to claim 1, and including a stationary mounting frame for securing said lift unit to a supporting structure, said lift unit being pivotally mounted to said mounting frame and including fluid-powered piston and cylinder means interconnecting said mounting frame and said lifting means for reciprocating pivotal movement of said lifting means between a lowered container loading and unloading position and a raised emptying position.

7. A lift unit according to claim 6, wherein said piston and cylinder means comprises first and second piston and cylinder assemblies, one end of each of said piston and cylinder assemblies secured to said mounting frame and the other end of said piston and cylinder assemblies secured to said lifting means.

8. A lift unit according to claim 7, wherein said first and second piston and cylinder assemblies are secured to said mounting frame and said lifting means in mutual angular offset to each other whereby at least one of said piston and cylinder assemblies is in a position of mechanical advantage during the entire movement cycle between the lowered container loading position, the raised emptying position and the lowered container unloading position.

9. A lift unit according to claim 6, and including folding means for folding said lifting arms into a collapsed, closed position of reduced depth against said mounting frame.

10. A lift unit according to claim 1, wherein said supporting structure comprises a refuse truck.

11. A method of lifting and emptying a waste container of the type having an enlarged lip proximate the mouth of the container, and comprising the steps of:

(a) providing a lift unit having a mounting frame with a pair of laterally opposed, spaced-apart lifting arms for receiving in partially encircling relation a waste container therebetween;

(b) providing an upper gripper and a lower gripper, both carried by an arm of said pair of lifting arms and extending laterally along opposing sides of the container when the container is in lifting position;

(c) gripping the enlarged lip of the waste container between the upper and lower grippers on each of the pair of lifting arms;

(d) lifting the waste container by the enlarged lip to a raised and inverted position for emptying;

(e) lowering the waste container from the raised and inverted position; and (f) releasing the grip of the upper and lower grippers on the enlarged lip to permit removal of the waste container from between the lifting arms.

12. A method of lifting and emptying a waste container according to claim 11, and including the step of adjusting the lifting arms to the width of the waste container.

13. A method of lifting and emptying a waste container according to claim 11, and including the step of adjusting the lifting arms to the height of the waste container.

14. A method of lifting and emptying a waste container according to claim 11, and including the step of supporting the waste container on one of its side walls while the waste container is lifted, emptied and lowered.

15. A method of lifting and emptying a waste container according to claim 11, and including the step of maintaining the lower gripper in a stationary position relative to the lifting arm to which it is attached and moving said upper gripper into and out of gripping cooperation with said lower gripper for alternately gripping and releasing the grip on the enlarged lip of said waste container.

16. A method of lifting and emptying a waste container according to claim 11, and including the step of locking the upper gripper into position on top of the enlarged lip of the container during lifting and inverting of the container.

17. A method of lifting and emptying a waste container according to claim 11, and including the step of folding said lifting arms into a collapsed, closed position of reduced depth against said mounting frame when said lift unit is not in operation.

* * * * *